US010243290B2

(12) United States Patent
Fehse

(10) Patent No.: US 10,243,290 B2
(45) Date of Patent: Mar. 26, 2019

(54) ELECTRIC CONNECTOR, PRINTED CIRCUIT BOARD AND PRODUCTION METHOD

(71) Applicant: Rohde & Schwarz GmbH & Co. KG, München (DE)

(72) Inventor: Dirk Fehse, Berlin (DE)

(73) Assignee: ROHDE & SCHWARZ GMBH & CO. KG, Munich (DE)

( * ) Notice: Subject to any disclaimer, the term of this patent is extended or adjusted under 35 U.S.C. 154(b) by 0 days.

(21) Appl. No.: 15/651,183

(22) Filed: Jul. 17, 2017

(65) Prior Publication Data

US 2019/0020136 A1 Jan. 17, 2019

(51) Int. Cl.

| | |
|---|---|
| ***H01R 12/71*** | (2011.01) |
| ***H01R 12/73*** | (2011.01) |
| ***H01R 13/33*** | (2006.01) |
| ***H01R 24/50*** | (2011.01) |

(52) U.S. Cl.

CPC ..... *H01R 12/73* (2013.01); *H01R 12/716* (2013.01); *H01R 13/33* (2013.01); *H01R 24/50* (2013.01)

(58) Field of Classification Search

CPC ..... H01R 12/73; H01R 12/716; H01R 13/33; H01R 24/50; H01R 13/562; H01R 13/58

USPC ..... 439/474

See application file for complete search history.

(56) References Cited

U.S. PATENT DOCUMENTS

| | | | | |
|---|---|---|---|---|
| 4,273,407 | A * | 6/1981 | Snuffer | H01R 24/52 439/579 |
| 4,577,054 | A * | 3/1986 | deRonde | H01R 9/05 174/361 |
| 4,629,278 | A * | 12/1986 | Norton | H05K 3/341 29/842 |
| 4,842,527 | A * | 6/1989 | Tellam | H01R 24/50 439/581 |
| 5,004,427 | A * | 4/1991 | Lindeman | H01R 13/2407 439/101 |
| 5,256,085 | A * | 10/1993 | Tan | H01R 12/716 439/372 |
| 5,899,754 | A * | 5/1999 | Beloritsky | H01R 24/52 439/158 |
| 6,099,322 | A * | 8/2000 | Beloritsky | H01R 13/111 439/41 |
| 6,102,736 | A * | 8/2000 | Leeb | H01R 13/6616 219/209 |
| 6,358,062 | B1 * | 3/2002 | Feldman | H01R 23/688 439/579 |
| 6,433,276 | B1 * | 8/2002 | Bellora | H01L 23/045 174/152 GM |
| 6,468,089 | B1 * | 10/2002 | Hubbard | H01R 24/50 439/63 |
| 6,743,058 | B1 * | 6/2004 | Cui | H01R 12/725 439/733.1 |
| 7,232,327 | B2 * | 6/2007 | Asai | H01R 12/716 439/331 |

(Continued)

*Primary Examiner* — Edwin A. Leon
*Assistant Examiner* — Oscar C Jimenez
(74) *Attorney, Agent, or Firm* — Westman, Champlin & Koehler, P.A.

(57) ABSTRACT

An electric connector for mounting on a printed circuit board and for establishing electrical contact with a counterpart connector comprises a main contact for establishing electrical contact with a contact of the counterpart connector, and a PCB connection band for attaching to the printed circuit board that is electrically coupled to the main contact.

18 Claims, 5 Drawing Sheets

(56) References Cited

U.S. PATENT DOCUMENTS

| | | | | |
|---|---|---|---|---|
| 7,344,381 | B2 * | 3/2008 | Kerekes | H01R 13/521 439/63 |
| 8,157,571 | B2 * | 4/2012 | Kadomatsu | H01R 24/50 439/63 |
| 8,297,985 | B1 * | 10/2012 | Beller | H01R 24/50 439/581 |
| 9,124,047 | B2 * | 9/2015 | Kanda | H01R 13/6474 |
| 9,692,168 | B1 * | 6/2017 | Schroll | H01R 13/502 |
| 2004/0038587 | A1 * | 2/2004 | Yeung | H01P 5/085 439/581 |
| 2005/0085112 | A1 * | 4/2005 | Zhang | H01R 43/205 439/135 |
| 2008/0176430 | A1 * | 7/2008 | Yuan | H01R 12/716 439/101 |
| 2009/0137133 | A1 * | 5/2009 | Gou | H01R 24/50 439/63 |
| 2009/0211808 | A1 * | 8/2009 | Falk | H01R 13/5216 174/667 |
| 2011/0104910 | A1 * | 5/2011 | Kadomatsu | H01R 24/50 439/63 |
| 2014/0273550 | A1 * | 9/2014 | Biddle | H01R 12/7005 439/63 |
| 2014/0273648 | A1 * | 9/2014 | Baumler | H01R 31/06 439/638 |
| 2015/0072188 | A1 * | 3/2015 | Dulle | B60R 16/03 429/61 |
| 2015/0333435 | A1 * | 11/2015 | Arai | H01R 12/716 439/589 |
| 2017/0162958 | A1 * | 6/2017 | Laighton | H01R 12/707 |
| 2017/0331235 | A1 * | 11/2017 | Yokoyama | H01R 13/5045 |
| 2017/0334375 | A1 * | 11/2017 | Shigyo | B60R 16/0239 |

* cited by examiner

100

200

ELECTRIC CONNECTOR, PRINTED CIRCUIT BOARD AND PRODUCTION METHOD

TECHNICAL FIELD

The present invention relates to an electric connector. The present invention further relates to a printed circuit board and a production method.

BACKGROUND

Although applicable in principal to any type of connector, the present invention and its underlying problem will be hereinafter described in combination with RF connectors for installation on PCBs.

Printed Circuit Boards or PCBs usually are connected to the outside world via connectors. Especially in RF or high speed applications, the connectors may be directly soldered onto the PCBs.

However, the design of common PCB mounted connectors introduces parasitic effects, especially parasitic capacities that may negatively influence signal transmission. The parasitic effects increase with increasing frequency and may e.g. cause return loss. This is especially true for RF applications in the GHz frequency range.

Therefore, for applications in the GHz range with such connectors very complex and expensive amplifiers are required to compensate the connector loss.

Against this background, the problem addressed by the present invention is providing improved PCB connectors.

SUMMARY

The present invention solves this problem by an electric connector with the features of claim 1, a printed circuit board with the features of claim 12 and a production method with the features of claim 14.

Accordingly it is provided:

An electric connector for mounting on a printed circuit board and for establishing electrical contact with a counter-part connector, the electric connector comprising a main contact for establishing electrical contact with a contact of the counterpart connector, a PCB connection band for attaching to the printed circuit board that is electrically coupled to the main contact, and may therefore also mechanically be coupled to the main contact.

Further, it is provided:

A printed circuit board comprising an electric connector for mounting on a printed circuit board and for establishing electrical contact with a counterpart connector, the electric connector comprising a main contact for establishing electrical contact with a contact of the counterpart connector, and a PCB connection band for welding to the printed circuit board that is electrically coupled to the main contact. The printed circuit board also comprises a signal track, also called signal line or signal path, wherein the PCB connection band is welded onto the signal track.

Further, it is provided:

A production method for producing an electric connector for mounting on a printed circuit board and for establishing electrical contact with a counter-part connector, the production method comprising providing a main contact for establishing electrical contact with a contact of the counter-part connector, and providing a PCB connection band with the main contact, the PCB connection band being provided for welding to the printed circuit board.

Connectors may comprise a round pin, solid or hollow, that passes from the connection end or outer end of the connector to the inner end or soldering end. The connection end or outer end may be the end that connects to the counterpart connector. The inner end or soldering end may be the end that is soldered to a PCB. If the connector comprises such a passing pin, the end of the pin on the inner end of the connector may be soldered onto a track of the PCB that accommodates the connector.

However, the round form of the pin will produce electrical capacities between the pin and the track of the PCB. The solder, e.g. tin-solder, will fill the gap between the round circumference of the pin and the PCB track. This arrangement will however produce the above mentioned losses in the connector that are especially detrimental at high frequencies in the GHz range.

The present invention therefore provides an arrangement or a construction that eliminates or at least reduces this adversary effects of round connection pins on the inner end of connectors.

The electric connector therefore comprises a main contact and a PCB connection band. The main contact may be a round pin (for a male connector) or tube (for a female connector). It is however understood, that the main contact may also have any other cross-section or shape, like e.g. a square cross-section.

The PCB connection band is in electrical communication with the main contact and may be electrically connected to a track on the PCB. This means that the PCB connection band may forward electrical signals between the PCB track and the main contact.

The PCB connection band may comprise a flat strap- or bandlike shape. The band may e.g. extend in longitudinal direction from the connection point with the main contact. However, the band may in addition or as alternative extend orthogonal to that longitudinal direction and e.g. form a kind of patch.

The flat surface of the PCB connection band provides for an increased contact surface with minimized distances between the PCB connection band and an underlying PCB track. Therefore, the arrangement of the present invention reduces any electric parasitic capacities that may be present between the PCB connection band and the underlying track of the PCB.

Therefore the matching or line matching in the connector and the PCB carrying the connector may be optimized with the arrangement of the present invention.

Further embodiments of the present invention are subject of the further subclaims and of the following description, referring to the drawings.

In a possible embodiment, the electric connector may comprise a shielding contact for establishing electrical contact with a shielding of the counterpart connector.

Usually cables, especially measurement cables for RF applications, comprise an inner signal conductor and an outer shielding. Providing the electrical connector with a shielding contact allows coupling the outer shielding of the cables to the shielding contact. On the other end, the shielding contact may be coupled to a ground or shielding of the PCB on which the electrical connector is arranged. This allows providing a complete or closed grounding or shielding in the signal chain from the cable or counterpart connector to the PCB and the device that houses the PCB.

In a possible embodiment, the shielding contact may form a connection cavity on an outer section of the electric connector, i.e. a section that is meant for connection to the counterpart connector, wherein the connection cavity houses the main contact. The shielding contact may further comprise soldering or welding portions or fixation elements on an inner section, i.e. a section that is meant for connection to PCB.

The shielding contact may form a kind of housing for the main contact. The connection cavity may accommodate the main contact such that the main contact is surrounded by the shielding contact without touching the shielding contact or being electrically coupled to the shielding contact. The main contact may e.g. be held in position by plastic that is injection molded into portions of the connection cavity. For example an inner or back section of the connection cavity may be filled with plastic, or any other non-conductive material, that holds the main contact in position. The front or outer section of the connection cavity may not be filled with the plastic and the pin may protrude into that unfilled section of the connection cavity.

The connection cavity may comprise a round cross-section. A round cross section allows providing the inner or outer walls of the connection cavity e.g. with a thread that allows securing the counterpart connector in position by screwing e.g. a cap of the counterpart connector to the connection cavity.

It is understood, that the connection cavity may also comprise a square or quadratic cross-section. A shielding contact with such a square or quadratic cross-section connection cavity may e.g. comprise clips or springs or any other snap-in mechanism to fix the counterpart connector.

In a possible embodiment, the main contact and the PCB connection band may be integrally formed of a single element.

This means that the metal pin provides the material of the main contact as well as the PCB connection band and there are no joints or junctures between the main contact and the PCB connection band. If the main contact and the PCB connection band are formed of a single element, no contact or transfer resistance or parasitic capacities or inductivities will be present.

In a possible embodiment, the main contact and the PCB connection band may be integrally formed of a metal pin, for a male contact, or metal tube, for a female contact.

A metal pin may directly be used at least as the contact section of the main contact that engages with a contact of the counterpart connector. Therefore, there is no need to further process the metal pin for use as the contact section. Further, a pin may e.g. be inserted or pressed into the shielding contact after the inner section of the shielding contact has e.g. been filled with plastic. A metal pin main contact therefore provides for a very easy manufacturing of the electric connector.

A metal tube may as well be used like the metal pin. However, when inserting the metal tube into the shielding contact it must be made sure that no residual plastic is in the tube.

In one embodiment, the PCB connection band may be formed by compression molding of an end section of the metal pin or metal tube, respectively. For example a molding press may be used, that molds or presses the end section of the metal pin or metal tube into the required shape.

If the main contact is manufactured e.g. by stamping, punching or die cutting, forming the front pin and the PCB connection band on the other end, may be performed consecutively or in a single step.

In a possible embodiment, the main contact and the PCB connection band may be formed of two separate elements that are electrically coupled to each other.

Depending on the dimensions and the construction of the electrical connector, the main contact and the PCB connection band may e.g. be electrically coupled inside of the electrical connector via wires, a pressed screen or lead frame or the like.

The PCB connection band may also be directly coupled to the main contact. The main contact may e.g. comprise a flat end wall or end face on the end that is connected to the PCB connection band. The PCB connection band may e.g. be welded, e.g. spot welded, or soldered to that flat wall or end face of the main contact. The main contact and the PCB connection band may therefore also be mechanically coupled directly to each other.

It is understood, that the main contact and the PCB connection band may be of any material that provides the necessary electrical conductivity. The main contact and the PCB connection band may e.g. be of the same material or of different materials, as required. In a possible embodiment, the main contact and/or the PCB connection band may therefore comprise a conductive material, especially a conductive metal, more especially copper and/or aluminum and/or silver and/or gold. It is understood, that an alloy of any one of the above mentioned materials is also possible.

In a possible embodiment, the main contact and/or the PCB connection band may comprise a gold coating and/or a silver coating and/or a platinum coating.

A gold or silver coating may improve the ability of the respective element to conduct electrical signals. Especially with high frequency signals, the so called skin effect becomes relevant. The skin effect refers to the signals being conducted on the outer skin of a conductor with increasing frequency. Therefore, for high frequency or RF signals, providing a silver, gold or platinum coating e.g. on a copper conductor may substantially improve the RF properties of the conductor. It is understood, that any other type of coating that supports the electric or RF properties of the main contact or the PCB connection band is also possible. It is understood, that an alloy of any one of the above mentioned materials is also possible.

In a possible embodiment, the electric connector may comprise a plurality of main contacts and a PCB connection band for every one of the main contacts. The electrical connector is described above as comprising a single main contact. It is however, understood, that the electrical connector may also comprise more than one main contact. It is further understood, that a dedicated PCB connection band will be provided for every main contact.

In a possible embodiment, the PCB connection band may comprise a dilatation or spring section in longitudinal direction. The dilatation section may be arranged between the main contact and a PCB connection point of the PCB connection band.

The dilatation or spring section may serve as a buffer between the PCB or the section of the PCB connection band that is soldered or connected to the PCB and the rest of the electrical connector. The dilatation or spring section may be self-supporting. This means that the dilatation or spring section may expand or contract in itself, without moving the section of the PCB connection band that is soldered or connected to the PCB or the section of the PCB connection band that is connected to the main contact.

Thermal stress may for example lead to thermal expansion of the PCB and the electrical connector. In addition, different materials may provide different thermal expansion coefficients. Thermal stress may e.g. act on the PCB connection band on one end, when the PCB connection band is soldered or welded onto an underlying PCB track.

To improve the electrical connection between the PCB connection band and the underlying PCB track, the PCB track may also comprise a coating. The coating may e.g. comprise an electrically conductive material like e.g. silver, gold or platinum. Especially, when a PCB connection band with a silver coating, a gold coating or a platinum coating is welded onto a PCB track with a silver coating, a gold coating or a platinum coating, parasitic effects are eliminated almost entirely. It is understood, that an alloy of any one of the above mentioned materials is also possible.

BRIEF DESCRIPTION OF THE DRAWINGS

For a more complete understanding of the present invention and advantages thereof, reference is now made to the following description taken in conjunction with the accompanying drawings. The invention is explained in more detail below using exemplary embodiments which are specified in the schematic figures of the drawings, in which.

Figure 1:
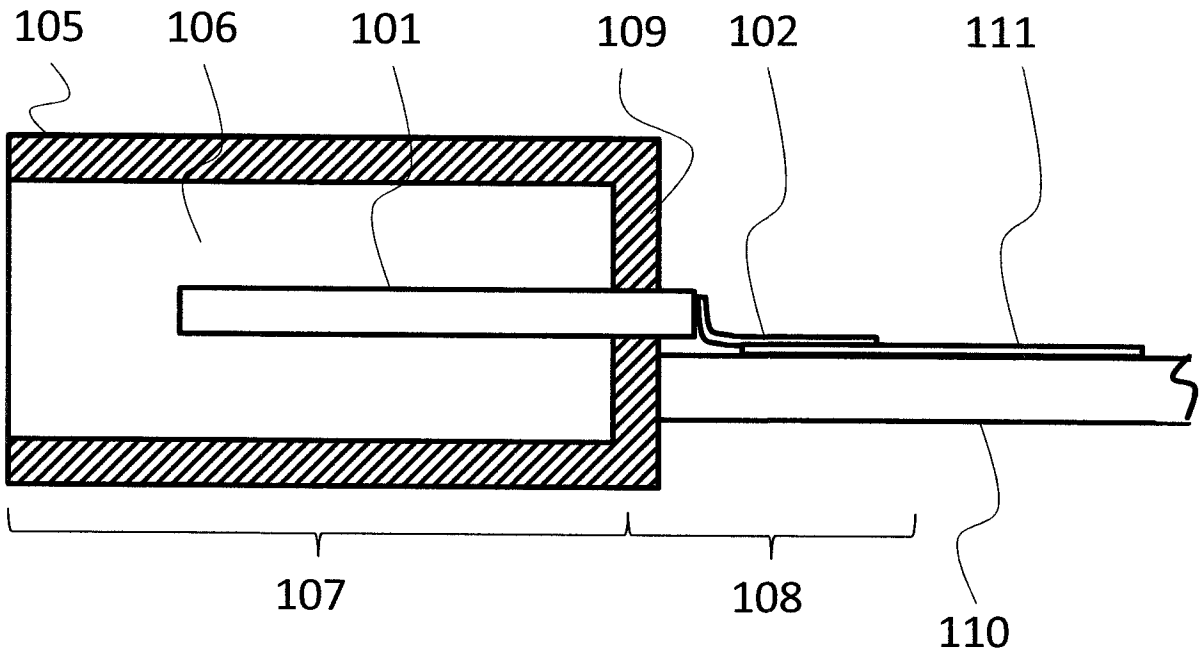
FIG. 1 shows a schematic side view of an embodiment of an electrical connector according to the present invention in a cross-section.

The appended drawings are intended to provide further understanding of the embodiments of the invention. They illustrate embodiments and, in conjunction with the description, help to explain principles and concepts of the invention. Other embodiments and many of the advantages mentioned become apparent in view of the drawings. The elements in the drawings are not necessarily shown to scale.

In the drawings, like, functionally equivalent and identically operating elements, features and components are provided with like reference signs in each case, unless stated otherwise.

DETAILED DESCRIPTION OF THE DRAWINGS

FIG. 1 shows a schematic side view of an embodiment of an electrical connector 100 in a cross-section. The electrical connector 100 may be mounted on a printed circuit board 110 for establishing electrical contact with a counterpart connector (not shown). The electrical connector 100 therefore establishes an electrical connection between a track 111 on the printed circuit board 110 and the counterpart connector.

To this end the electrical connector 100 comprises a main contact 101. The main contact 101 is provided in a connection cavity 106 that is formed by a shielding contact 105. The main contact 101 protrudes through a back wall 109 of the shielding contact 105. In addition a PCB connection band 102 is provided on the end of the main contact 101 that protrudes through the back wall 109. The PCB connection band 102 is provided as a flat band that on one end bends up about 90° to contact the main contact 101. On the other end the PCB connection band 102 lies flat on the printed circuit board 110 and may be connected to the track 111 of the printed circuit board 110.

In the electrical connector 100 the main contact 101 and the PCB connection band 102 are formed of two separate elements that are directly coupled to each other electrically and mechanically, e.g. by spot welding the PCB connection band 102 to the back face of the main contact 101.

The main contact 101 and the PCB connection band 102 may however also be integrally formed of a single element. The main contact 101 and the PCB connection band 102 may e.g. be formed of a metal pin or metal tube. In this case, the PCB connection band 102 may be formed by compression molding of an end section of the metal pin.

Further, the main contact 101 and the PCB connection band 102 may comprise copper, aluminum, silver, gold or platinum. Further, if the main contact 101 and the PCB connection band 102 are e.g. formed mainly of copper, the main contact 101 and the PCB connection band 102 may comprise a gold coating, a silver coating or a platinum coating. The same applies to the track 111 of the printed circuit board 110. Usually such tracks 111 will be provided as copper tracks 111. Therefore, the track 111 may also be provided with a gold coating, a silver coating or a platinum coating.

The main contact 101 and the PCB connection band 102 may then be welded onto the track 111 e.g. by spot-welding.

The shielding contact 105 comprises two sections, the outer section 107 and the inner section 108. The outer section 107 may be the section of the electrical connector 100 that protrudes out of a housing of a device (not shown) that carries the printed circuit board 110. The inner section 108 would be inside of such a housing.

The outer section 107 comprises the connection cavity 106 and the main part of the main contact 101. The inner section 108 comprises the PCB connection band 102.

The connection cavity 106 may e.g. comprise a circular circumference in a front view. Not shown is a possible inner or outer thread that may be provided with the connection cavity 106.

Figure 2:
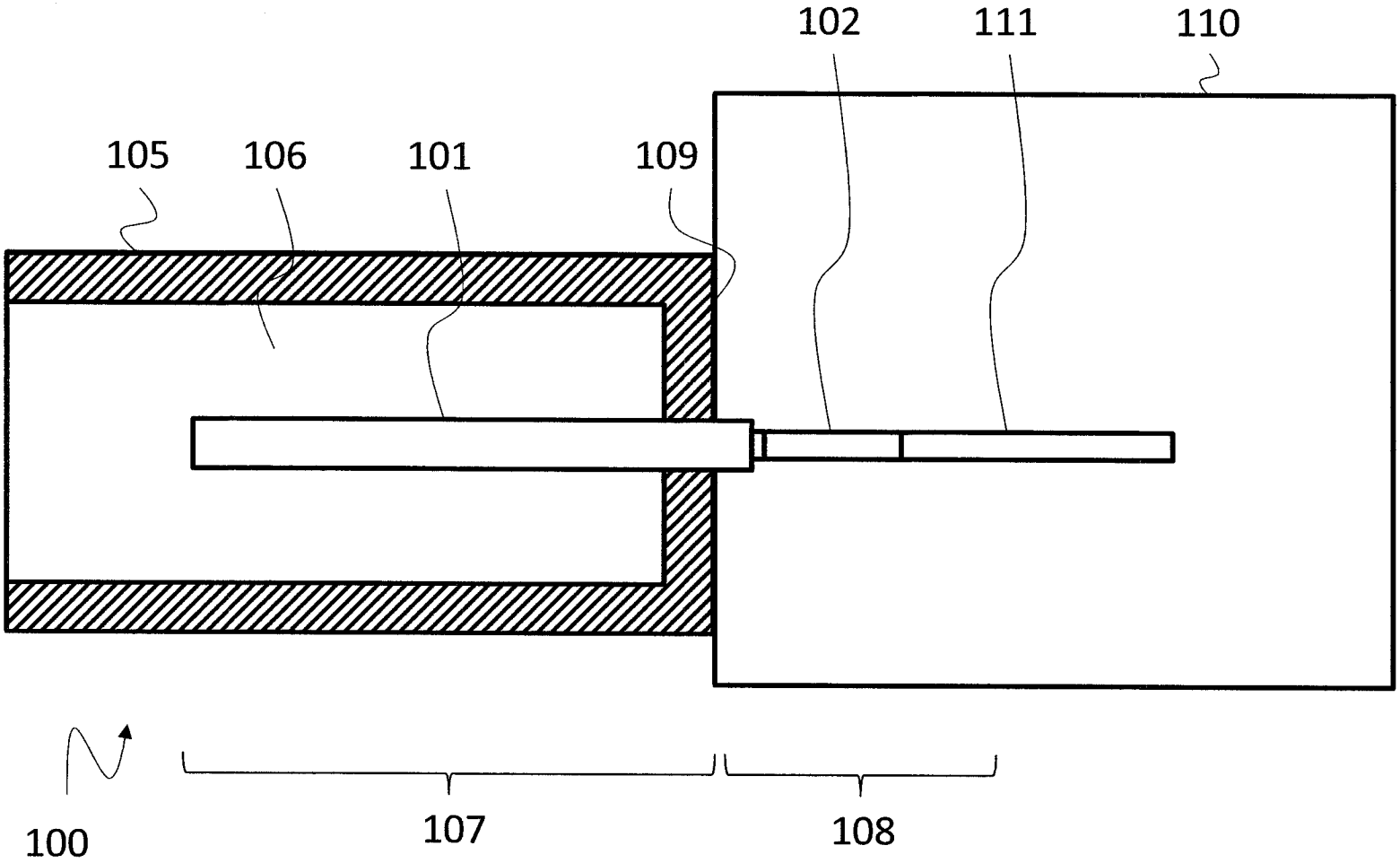
FIG. 2 shows a schematic top view of the embodiment of an electrical connector of FIG. 1 in a cross-section.

FIG. 2 shows a schematic top view of the embodiment of an electrical connector of FIG. 1 in a cross-section. In the top view it can be seen that the PCB connection band 102 overlaps the track 111. This overlap is necessary to perform the spot welding of the PCB connection band 102 to the track 111.

It is understood, that any other type of fixation of the PCB connection band 102 to the track 111 may also be used. Possible fixations include soldering and gluing.

Figure 3:
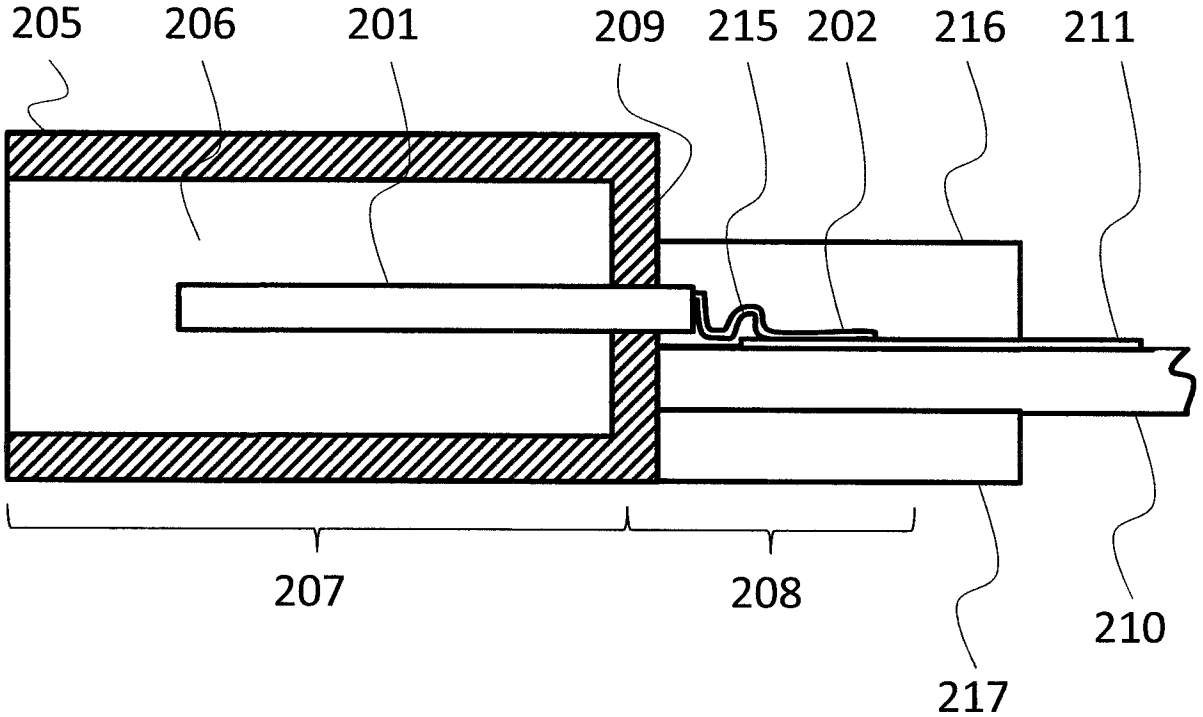
FIG. 3 shows a schematic side view of another embodiment of an electrical connector according to the present invention in a cross-section.

FIG. 3 shows a schematic side view of another embodiment of an electrical connector 200 in a cross-section. The electrical connector 200 is based on the electrical connector 100. Therefore, the electrical connector 200 comprises a main contact 201. The main contact 201 is provided in a connection cavity 206 that is formed by a shielding contact 205. The main contact 201 protrudes through a back wall 209 of the shielding contact 205. In addition a PCB connection band 202 is provided on the end of the main contact 201 that protrudes through the back wall 209.

The PCB connection band 202 is provided as a flat band that on one end bends up about 90° to contact the main contact 201. On the other end the PCB connection band 202 lies flat on the printed circuit board 210 and may be connected to a track 211 of the printed circuit board 210. Between the two ends, the PCB connection band 202 comprises a dilatation section 215. The dilatation section 215 of the PCB connection band 202 is provided as a meander-like section that extends away from the printed circuit board 210. It is understood, that any other type of dilatation section 215 may also be provided. As explained above, the dilatation section 215 serves to absorb mechanical stress such that no direct mechanical stress is transmitted via the PCB connection band 202 from the printed circuit board 210 to the main contact 201 or vice versa.

The shielding contact 205 of the electrical connector 200 further comprises fixation elements 216, 217. The fixation element 216 is provided on the top side of the printed circuit board 210 and the fixation element 217 is provided under the printed circuit board 210.

The fixation elements 216, 217 may on the one hand serve to fix the electrical connector 200 to the printed circuit board 210. On the other hand the fixation elements 216, 217 may also establish an electrical connection between the shielding contact 205 and e.g. a ground connection of the printed circuit board 210.

Figure 4:
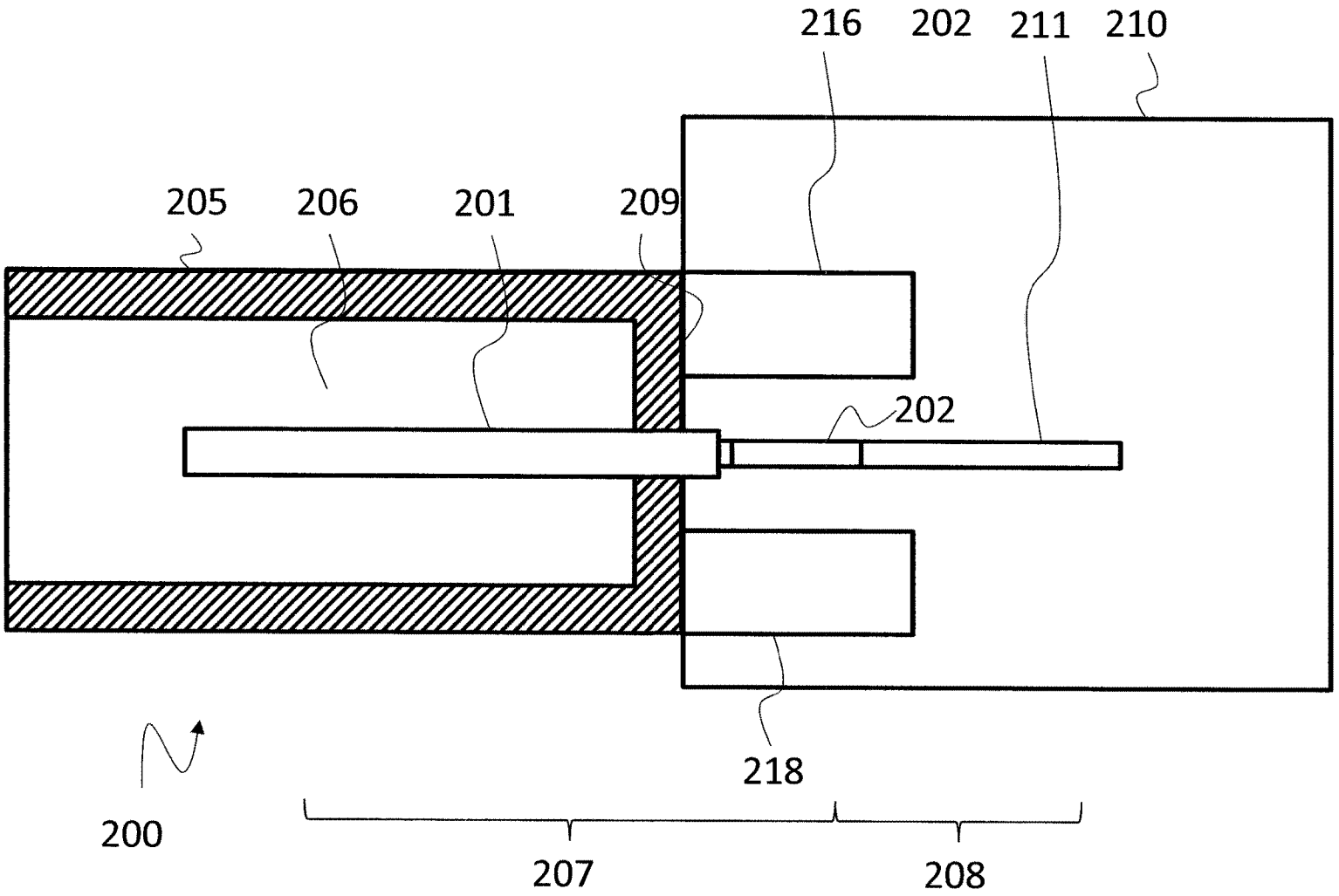
FIG. 4 shows a schematic top view of the embodiment of an electrical connector of FIG. 3 in a cross-section.

FIG. 4 shows a schematic top view of the embodiment of an electrical connector of FIG. 3 in a cross-section. It can be seen that another fixation element 218 is provided. The electrical connector 200 may therefore comprise e.g. four fixation elements 216, 217, 218 (only three may be seen in the figures). Two fixation elements 216 and 218 may be provided on top of the printed circuit board 210, and two fixation elements 217 may be provided below the printed circuit board 210.

For sake of clarity in the following description of the method based FIG. 5 the reference signs used above in the description of apparatus based FIGS. 1-4 will be maintained.

Figure 5:
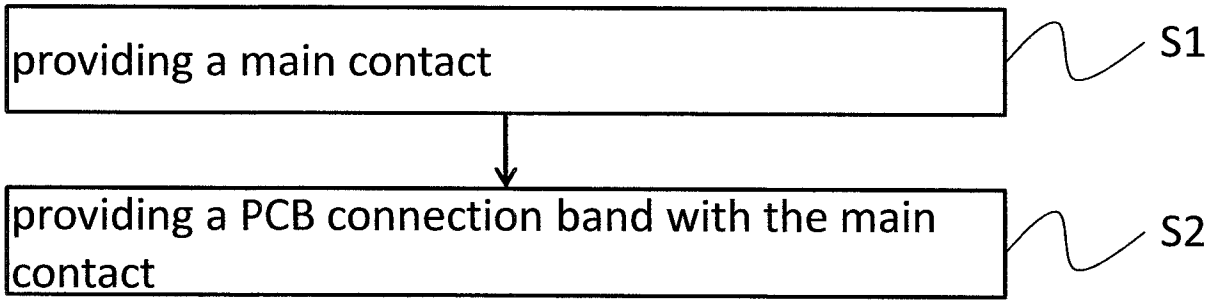
FIG. 5 shows a flow diagram of an embodiment of a method according to the present invention.

FIG. 5 shows a flow diagram of an embodiment of a production method for producing an electric connector 100, 200 for mounting on a printed circuit board 110, 210 and for establishing electrical contact with a counter-part connector.

The production method comprises providing a main contact 101, 201 for establishing electrical contact with a contact of the counterpart connector, and providing a PCB connection band 102, 202 with the main contact 101, 201, the PCB connection band 102, 202 being provided for welding to the printed circuit board 110, 210.

A shielding contact 105, 205 for establishing electrical contact with a shielding of the counterpart connector may be arranged around the main contact 101, 201 for shielding the main contact 101, 201. The shielding contact 105, 205 may form a connection cavity 106, 206 on an outer section 107, 207 of the electric connector 100, 200 and may comprise soldering or welding portions or fixation elements 216, 217, 218 on an inner section 108, 208 of the electric connector 100, 200. The production method may further comprise arranging the main contact 101, 201 in the connection cavity 106, 206.

The main contact 101, 201 and/or the PCB connection band 102, 202 may comprise copper and/or aluminum and/or silver and/or gold. Further, the method may comprise coating the main contact 101, 201 and/or the PCB connection band 102, 202 with a gold coating and/or a silver coating and/or a platinum coating. The same applies to the shielding contact 105, 205.

Further, a dilatation section 215 may be arranged in longitudinal direction on the PCB connection band 102, 202 between the main contact 101, 201 and a PCB connection point of the PCB connection band 102, 202, especially by molding, more especially by compression molding.

Further, the main contact 101, 201 and the PCB connection band 102, 202 may be integrally formed of a single element. For example, the main contact 101, 201 and the PCB connection band 102, 202 may be integrally formed of a metal pin or metal tube. The PCB connection band 102, 202 may be molded at an end section of the metal pin with the material of the metal pin.

The method may further comprise forming the main contact 101, 201 and the PCB connection band 102, 202 of two separate elements and electrically coupling the two elements to each other. In this case, the PCB connection band 102, 202 may e.g. be welded to the main contact 101, 201.

Although only one main contact 101, 201 is mentioned above, the production method may further comprise providing a plurality of main contacts 101, 201 and a PCB connection band 102, 202 for every one of the main contacts 101, 201.

Although specific embodiments have been illustrated and described herein, it will be appreciated by those of ordinary skill in the art that a variety of alternate and/or equivalent implementations exist. It should be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

In the foregoing detailed description, various features are grouped together in one or more examples or examples for the purpose of streamlining the disclosure. It is understood that the above description is intended to be illustrative, and not restrictive. It is intended to cover all alternatives, modifications and equivalents as may be included within the scope of the invention. Many other examples will be apparent to one skilled in the art upon reviewing the above specification.

Specific nomenclature used in the foregoing specification is used to provide a thorough understanding of the invention. However, it will be apparent to one skilled in the art in light of the specification provided herein that the specific details are not required in order to practice the invention. Thus, the foregoing descriptions of specific embodiments of the present invention are presented for purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. Throughout the specification, the terms "including" and "in which" are used as the plain-English equivalents of the respective terms "comprising" and "wherein," respectively. Moreover, the terms "first," "second," and "third," etc., are used merely as labels, and are not intended to impose numerical requirements on or to establish a certain ranking of importance of their objects.

LIST OF REFERENCE SIGNS

100, 200 electric connector
101, 201 main contact

102, 202 PCB connection band
105, 205 shielding contact
106, 206 connection cavity
107, 207 outer section
108, 208 inner section
109, 209 back wall
110, 210 printed circuit board
111, 211 signal track
215 dilatation section
216, 217, 218 fixation elements
S1, S2 method steps

The invention claimed is:

1. An electric connector for mounting on a printed circuit board and for establishing electrical contact with a counterpart connector, the electric connector comprising:

a main contact for establishing electrical contact with a contact of the counterpart connector, and a PCB connection band for attaching to the printed circuit board that is electrically coupled to the main contact, wherein said PCB connection band comprises a flat strap- or bandlike shape, wherein the main contact and the PCB connection band are formed of two separate elements that are electrically coupled to each other;

wherein the PCB connection band comprises a dilatation section in a longitudinal direction, wherein the dilatation section is arranged between the main contact and a PCB connection point of the PCB connection band; and wherein one end of the PCB connection band bends up 90 degrees to contact the main contact, and the other end of the PCB connection band lies flat on the printed circuit board.

2. The electric connector of claim 1, comprising a shielding contact for establishing electrical contact with a shielding of the counterpart connector.

3. The electric connector of claim 2, wherein the shielding contact forms a connection cavity on an outer section of the electric connector, wherein the connection cavity houses the main contact, and wherein the shielding contact comprises soldering or welding portions or fixation elements on an inner section.

4. The electric connector of claim 1, wherein the PCB connection band is welded to the main contact.

5. The electric connector of claim 1, wherein the main contact and/or the PCB connection band comprise a conductive material.

6. The electric connector of claim 1, wherein the main contact and/or the PCB connection band comprises a gold coating and/or a silver coating and/or a platinum coating.

7. The electric connector of claim 1, comprising a plurality of main contacts and a PCB connection band for every one of the main contacts.

8. The electric connector of claim 1, wherein the PCB connection band comprises a dilatation section in a longitudinal direction, wherein the dilatation section is arranged between the main contact and a PCB connection point of the PCB connection band.

9. A printed circuit board comprising:

an electric connector for mounting on a printed circuit board and for establishing electrical contact with a counterpart connector, the electric connector comprising a main contact for establishing electrical contact with a contact of the counterpart connector, a PCB connection band for attaching to the printed circuit board that is electrically coupled to the main contact, said PCB connection band comprising a flat strap- or bandlike shape, said PCB connection band comprising a dilation section in a longitudinal direction, wherein the dilatation section is arranged between the main contact and a PCB connection point of the PCB connection band, and one end of the PCB connection band bends up 90 degrees to contact the main contact and the other end of the PCB connection band lies flat on the printer circuit board, and a signal track, wherein the PCB connection band is attached to the signal track.

10. The printed circuit board according to claim 9, wherein the signal track comprises a coating, wherein the coating comprises a conductive material.

11. A production method for producing an electric connector for mounting on a printed circuit board and for establishing electrical contact with a counter-part connector, the production method comprising:

providing a main contact for establishing electrical contact with a contact of the counterpart connector, providing a PCB connection band with the main contact, the PCB connection band comprising a flat like strap- or bandlike shape and being provided for attaching to the printed circuit board, forming the main contact and the PCB connection band of two separate elements and electrically coupling the two elements to each other; and arranging a dilatation section in a longitudinal direction on the PCB connection band between the main contact and a PCB connection point of the PCB connection band;

wherein one end of the PCB connection band bends up 90 degrees to contact the main contact, and the other end of the PCB connection band lies flat on the printed circuit board.

12. The production method of claim 11, comprising arranging a shielding contact for establishing electrical contact with a shielding of the counterpart connector around the main contact for shielding the main contact.

13. The production method of claim 12, wherein the shielding contact forms a connection cavity on an outer section of the electric connector and comprises soldering or welding portions or fixation elements on an inner section of the electric connector, and wherein the production method comprises arranging the main contact in the connection cavity.

14. The production method of claim 11, comprising welding the PCB connection band to the main contact.

15. The production method of claim 11, comprising forming the main contact and/or the PCB connection band of copper and/or aluminum and/or silver and/or gold.

16. The production method of claim 11, comprising coating the main contact and/or the PCB connection band with a gold coating and/or a silver coating and/or a platinum coating.

17. The production method of claim 11, comprising providing a plurality of main contacts and a PCB connection band for every one of the main contacts.

18. The production method of claim 11, comprising arranging a dilatation section in a longitudinal direction on the PCB connection band between the main contact and a PCB connection point of the PCB connection band.

* * * * *